US006205933B1

(12) United States Patent
Dantlgraber

(10) Patent No.: US 6,205,933 B1
(45) Date of Patent: Mar. 27, 2001

(54) SUPPORT FOR A VEHICLE BODY ON A CHASSIS

(75) Inventor: Jörg Dantlgraber, Lohr/Main (DE)

(73) Assignee: Mannesmann Rexroth AG, Lohr/Main (DE)

( * ) Notice: Subject to any disclaimer, the term of this patent is extended or adjusted under 35 U.S.C. 154(b) by 0 days.

(21) Appl. No.: 09/068,133

(22) PCT Filed: Sep. 19, 1996

(86) PCT No.: PCT/EP96/04104

§ 371 Date: Apr. 30, 1998

§ 102(e) Date: Apr. 30, 1998

(87) PCT Pub. No.: WO97/17243

PCT Pub. Date: May 15, 1997

(30) Foreign Application Priority Data

Nov. 8, 1995 (DE) ..... 195 41 611

(51) Int. Cl.[7] ..... B61F 1/00; B61F 5/00

(52) U.S. Cl. ..... 105/453; 105/199.1; 105/199.2; 105/199.3

(58) Field of Search ..... 105/199.3, 201, 105/453, 199.1, 199.2

(56) References Cited

U.S. PATENT DOCUMENTS 1,921,913 8/1933 Drenning .
1,958,806 5/1934 Symington .
5,671,682 * 9/1997 Holzl et al. ..... 105/199.2

FOREIGN PATENT DOCUMENTS 4444093 6/1995 (DE) .
1098424 1/1968 (GB) .

* cited by examiner

*Primary Examiner*—S. Joseph Morano
*Assistant Examiner*—Robert J. McCarry, Jr.
(74) *Attorney, Agent, or Firm*—Martin A. Farber

(57) ABSTRACT

A support for a car body on a chassis, in particular on a truck of a rail vehicle. A support comprises a fluid-actuated piston-cylinder unit arranged between car body and chassis, and a rocker support arranged also between car body and chassis which comprises a first support part and a second support part which is arranged between the first support part and a part of the car. Each support part has a rolling surface via which it rests on another rolling surface, in which connection at least one rolling surface of the two rolling surfaces contacting each other is cylindrical and the contact between a pair of rolling surfaces is linear. The support part takes up little space. The distance between the car body and the chassis can be very small. This is achieved in that at least one of the two support parts is developed in annular shape; that the piston-cylinder unit is located within the at least one annular support part; and that the cylinder of the piston-cylinder unit is provided with an outer flange having a rolling surface against which the annular support part rests via a rolling surface, and the piston of the piston-cylinder unit rests on another part.

16 Claims, 4 Drawing Sheets

SUPPORT FOR A VEHICLE BODY ON A CHASSIS

FIELD AND BACKGROUND OF THE INVENTION

The present invention relates to a support for a car body on a chassis.

Such a support is known from DE 44 44 093 A1. The support shown there comprises a rocker support and a fluid-actuated piston-cylinder unit, by means of which the distance between the chassis and the body of the car can be changed. The rocker support has a first support part and a second support part which is arranged between the first support part and the chassis. The second support part lies with a circular-cylindrical rolling surface on a flat rolling surface of the chassis. The first support part lies with a circular-cylindrical rolling surface on a flat rolling surface of the second support part, the axis of the circular-cylindrical rolling surface traveling on the first support part perpendicular to the axis of the circular-cylindrical rolling surface on the second support part. The piston-cylinder unit is inserted between the first support part and the car body. This known support is rather high and therefore requires a relatively large amount of space in vertical direction between the chassis and the car body. This space is not always available.

SUMMARY OF THE INVENTION

The object of the present invention is therefore so further to develop a support of this type which it takes up little space in the axial direction of the piston-cylinder unit.

This object is achieved for a support of this type by the invention. In an arrangement in accordance with the invention therefor, the piston-cylinder unit is at least partially within an annular support part so that an axially available space is used at the same time for the support part and the piston-cylinder unit and a short manner of construction is made possible.

In principle, it is possible for the piston-cylinder unit to act between two support parts, with which therefore the axial distance between these two support parts can be changed by it. However, since upon a change in the axial distance between two support parts, the kinematics of the rocker support is also changed, the piston-cylinder unit is arranged between a part of the car and second support part. The piston then rests in this connection on the part of the car and the cylinder of the piston-cylinder unit resting on the second support part, this second support part being of annular development and the cylinder extending into the second support part. In particular, the piston-cylinder unit is arranged between the chassis and the second support part. This is favorable, in particular, when other hydraulic components and hydraulic lines are also present on the chassis since in such case the pressure fluid can be fed through the piston or the cylinder of the piston-cylinder unit without long lines.

The construction space in axial direction required for the piston-cylinder unit results from the desired maximum change in distance between chassis and car body and the dimensions of the structural parts required for dependable operation. In order to be able to arrange a relatively long piston-cylinder unit in space-saving manner, several support parts are developed in annular shape so that the piston-cylinder unit can extend into several annular support parts.

In accordance with a particularly preferred embodiment, the second support part is of annular development and has a flange with a rolling surface on a hollow cylinder. The first support part is also annular and rests with a rolling surface on the flange of the second support part. In order that the second support part withstands also the high stresses which are frequently required, the hollow cylinder of the second support part protrudes over its flange in the direction towards the first support part. By the long, hollow cylinder the second support part receives the desired stability. The second support part can extend into the inside of the first support part or extend axially outward beyond the first support part.

By the rolling surfaces between the second support part and the one car part as well as between the first support part and the second support part, a sort of universal joint is created between the rocker support and the one car part. In order to form a universal joint between the rocker support and the other car part, a third support part is provided which by two rolling surfaces cooperates with corresponding rolling surfaces on the other car part and on the first support part. The third support part, now, is also developed annularly so that the piston-cylinder unit can be made very long without taking up additional space. In order to obtain high stability of the third support part, it also can be provided with a hollow cylinder with which it passes into the first support part or engages outward axially over the first support part.

If the second or the third support part extends into the first support part, and if the other support part extends over the first support part, then the hollow cylinders of the second and third support parts can be made very long. To be sure, the second support part and third support part then differ from each other in their shape. They can be identical to each other if, they extend the same distance axially outside or inside over the first support part. In order fully to utilize the space available, the hollow cylinders can advantageously extend up to close to a central horizontal plane of the rocker support.

BRIEF DESCRIPTION OF THE DRAWINGS

With the above and other objects and advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
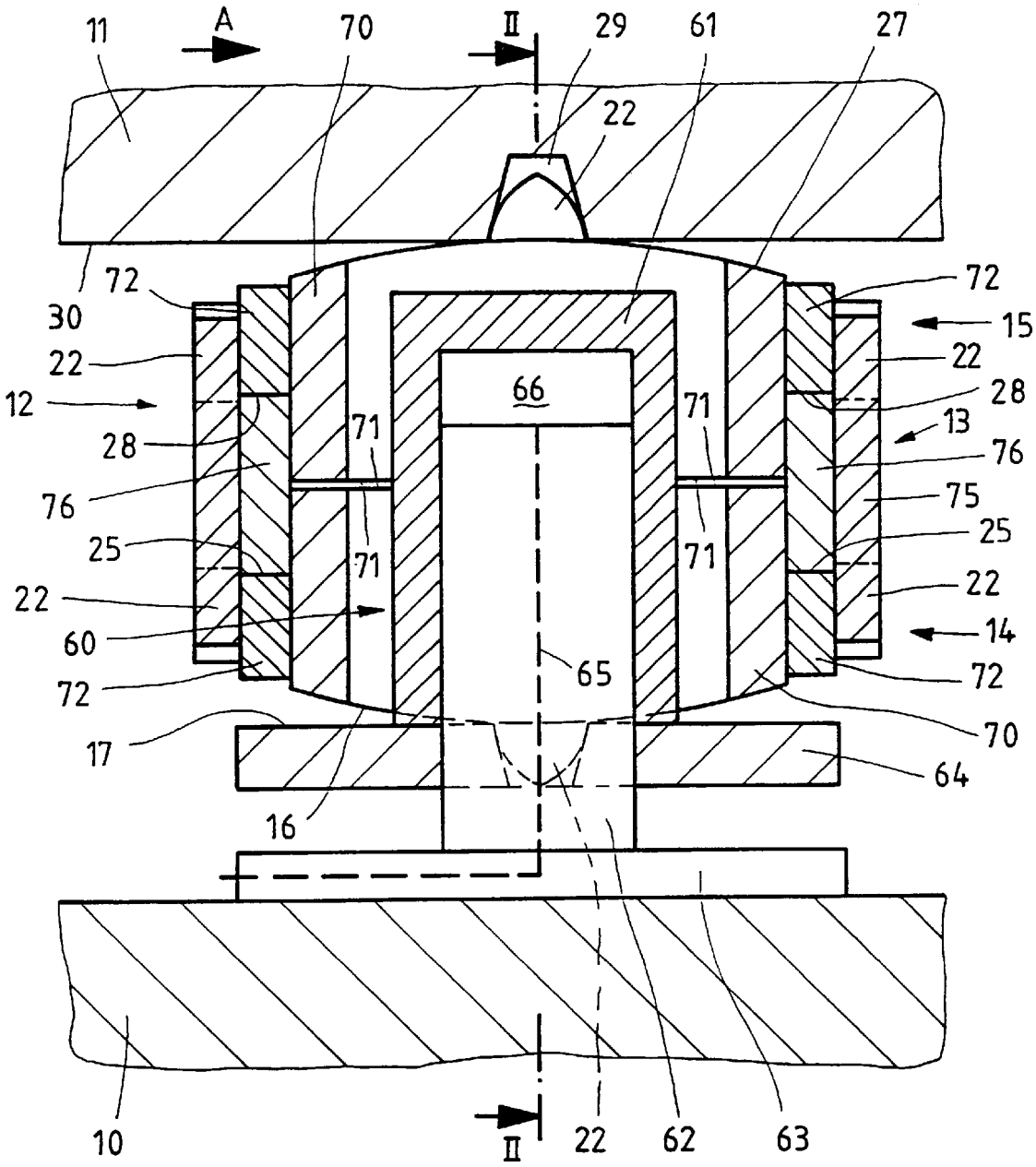
FIG. 1 shows, in a vertical section passing centrally through the rocker support, the first embodiment, the rocker support of which has a first support part as well as a second support part and a third support part which extend axially into the first support part.
Figure 2:
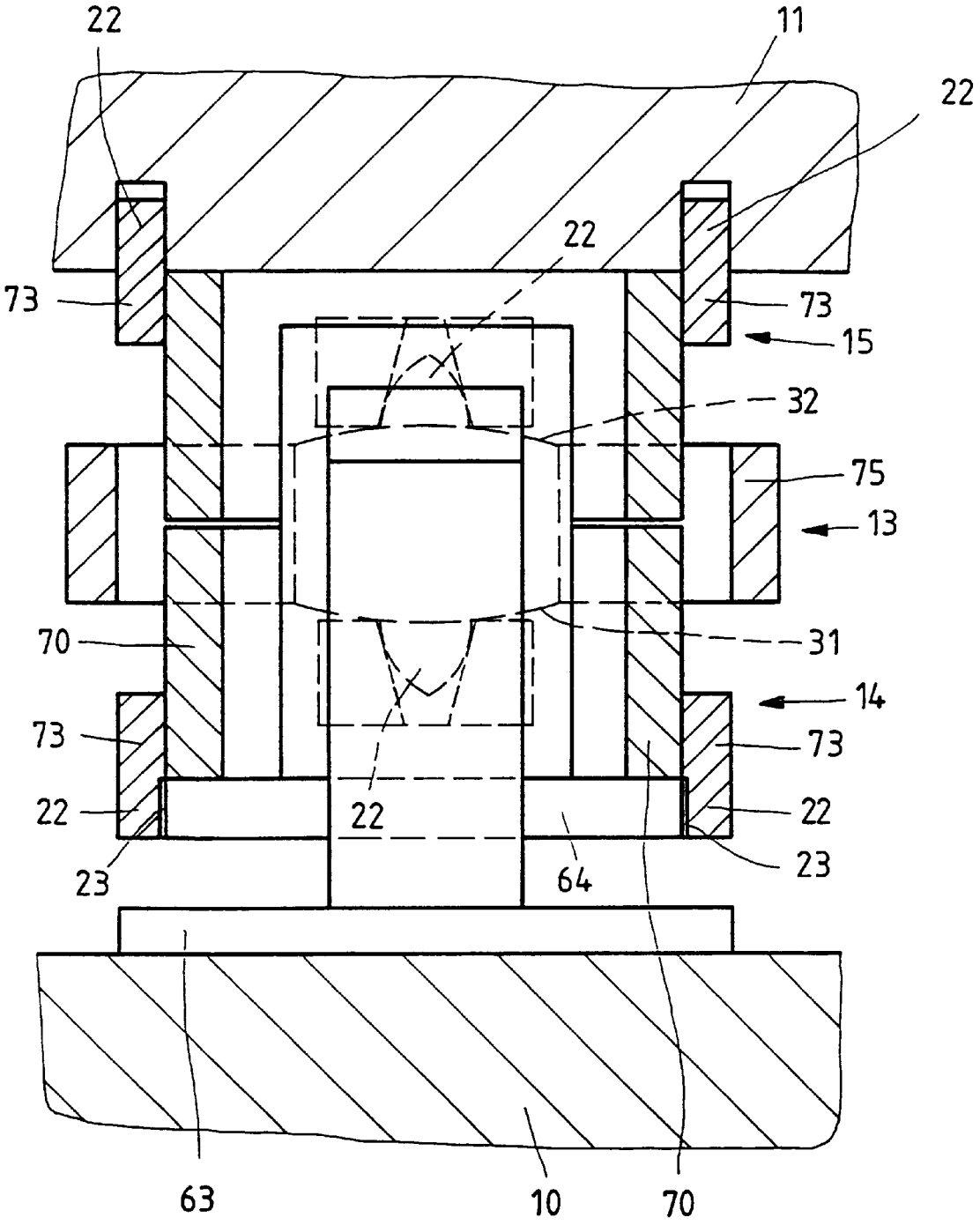
FIG. 2 shows a section along the line II—II of FIG. 1.
Figure 4:
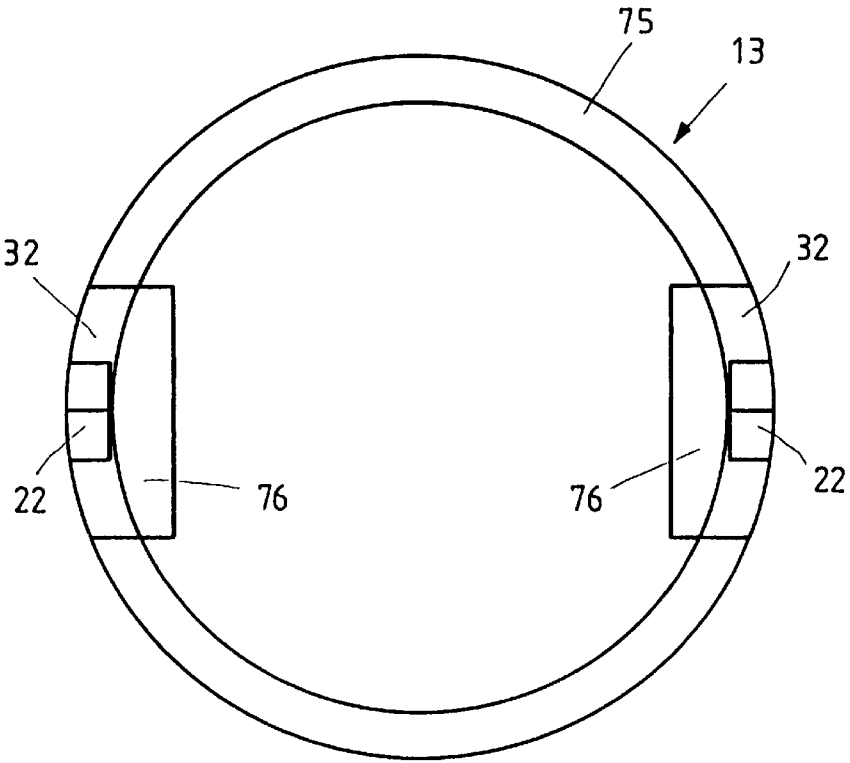
FIG. 4 is a top view of the first support part of the first embodiment.
Figure 3:
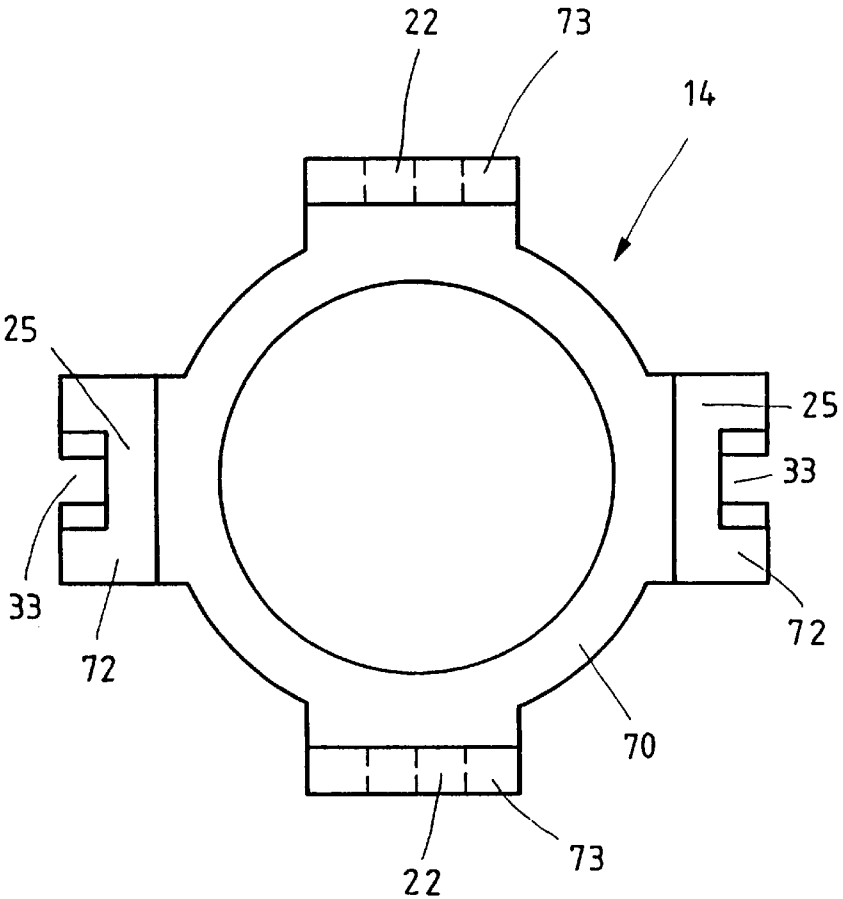
FIG. 3 is a top view of the second or third support part of the first embodiment.

FIGS. 1 and 2 shows a part of a truck 10 and a part of a car body 11 of a rail vehicle. Between the truck 10 and the car body 11 there are two rocker supports and two piston-cylinder units, one of which is shown in each case in the figures.

The piston-cylinder unit designated as a whole by the reference numeral 60 comprises a cylinder 61 which is open towards the truck 10 and a single-acting plunger piston 62 which is guided in a manner tight against pressurized fluid in the cylinder 61 and extends out of the cylinder 61 in the direction towards the truck 10. On its truck end it is attached to a plate 63 which is fastened to the truck. The cylinder 61 bears on the end thereof close to the truck 10 an annular flange 64 the annular surface 17 of which facing away from the truck 10 is flat. A pressurized-fluid channel 65, via which pressurized fluid can be fed to a pressure chamber 66 between the plunger piston 62 and the cylinder 61 or discharged from the pressure chamber extends radially through the plate 63 and axially through the plunger piston 62.

The rocker support, designated as a whole by the reference numeral 12, comprises essentially three parts, namely a central first support part 13, a second support part 14 which is arranged between the first support part and the truck 10, and a third support part 15 which is arranged between the first support part 13 and the car body 11. All three support parts 13, 14 and 15 are of annular development, in particular in the form of a circular ring in the embodiment shown as example, between the annular flange 64 of the cylinder 61 and the car body 11 and surround the cylinder 61, which extends into all three support parts, radially at such a distance that the rocker support 12 can be deflected by the required angle without this being prevented by the piston-cylinder unit 60.

The second support part 14 has a hollow cylinder 70 the annular surface 17 of which, serving as rolling surface, on the end facing the annular flange 64 of the cylinder 61 is developed as a circular-cylindrical rolling surface 16 the axis of which extends perpendicular to the axis of the hollow cylinder and which lies linearly on the flat rolling surface 17 of the annular flange 64 and can roll on said surface. The linear application is present within the established rolling path in each case in two partial sections the length of which is minimal in a central neutral position of the support part 14 and increases upon deflection of the support part. By a development of the hollow cylinder 17 which is rectangular in cross section, the length of the partial sections can also be maintained constant. The other end 71 of the hollow cylinder 70 lies in a plane which extends perpendicular to the axis of the hollow cylinder and is located just below the mid-height of the rocker support 12.

Displacement of the second support part 14 relative to the annular flange 64 in a direction perpendicular to the generatrices of the circular-cylindrical rolling surface 16 is prevented by two teeth 22, which, lying diametrically opposite each other in the direction of the generatrices, are borne by blocks 73 which are fastened to the hollow cylinder 70, extend over the rolling surface 16 of the second support part, and in each case engage into a recess 23 in the annular flange 64. The flanks of the teeth 22 start at the rolling surface 16 on which the teeth are seated and which in cross section represent involutes to a circle. The profile of a tooth corresponds therefore to an involute toothing. The recesses 23 have a trapezoidal cross section. The tooth flanks and the flanks of the recesses contact each other linearly. Upon the rolling of the second support part 14 on the annular flange 64, roll-sliding takes place between the teeth 22 and the recesses 23. By the teeth 22, locking against rotation is also assured between the support part 14 and the annular flange 64.

Shifted 90° from the teeth 22, two blocks 72 which lie diametrically opposite each other are fastened on the outside on the hollow cylinder 70 of the support part 14, the top sides of said blocks facing away from the annular flange 64 lie in a common plane extending perpendicular to the axis of the hollow cylinder 70 and together form a flat rolling surface 25 on the support part 14 for the first support part 13. From FIG. 1 it can be clearly noted that the hollow cylinder 70 extends over the rolling surface 25. In this way, the support part 14 is of particularly stable shape.

The third support part 15 is identical in shape to the second support part 14, but it is installed, turned 180° from the support part 14 around an axis extending parallel to the generatrices of the rolling surface 16. Accordingly, it has, on a hollow cylinder 70, a rolling surface 27 identical to the circular-cylindrical rolling surface 16 of the support part 14 the blocks 73 bearing teeth 22 and a flat rolling surface 28, facing the first support part 13, on two blocks 72 fastened to the hollow cylinder 71. By the two teeth 22 the support part 15 engages in two depressions 23 in the car body 11. A flat rolling surface 30 of the car body rests on the circular-cylindrical rolling surface 27 of the support part 15.

The two support parts 14 and 15 lie with their flat ends 71 at a slight distance from each other. They are held at this distance apart by the central, first support part 13. The latter, by a hollow cylinder 75, surrounds the hollow cylinders 70 of the support parts 14 and 15 at a radial distance apart. At two diametrically opposite places, each end of the hollow cylinders 75 is developed as a circular-cylindrical rolling surface 31 and 32 respectively. These rolling surfaces extend axially over the other regions of the end surfaces and are widened inwards by segments 76 arranged on the inside on the hollow cylinders 75. They have the same curvature. The rolling surface 31 lies on the flat rolling surface 25 of the support part 14 and the rolling surface 32 lies on the flat rolling surface 28 of the support part 15. In the circular-cylindrical regions of the ends of the hollow cylinder 75 there is present in each case a tooth 22 by which the support part 13 engages into trapezoidal recesses 33 in the blocks 72 of the support parts 14 and 15. As a whole, the central support part 13 is symmetrical with respect to a central plane which extends parallel to the generatrices of the rolling surfaces 31 and 32 and coincides in the central position of the rocker support 12 with the central plane thereof. The generatrices of the circular-cylindrical rolling surfaces 31 and 32 of the support part 13 extend perpendicular to the generatrices of the circular-cylindrical rolling surfaces 16 and 27 of the support parts 14 and 15. The generatrices of the rolling surfaces 16 and 27 may for instance extend in the longitudinal direction of the truck 10 and the generatrices of the rolling surfaces 31 and 32 extend perpendicular to the lengthwise direction of the truck 10. By the engagement of the teeth 22 in the corresponding recesses or depressions, all parts of the rocker support 12 as well as of the cylinders 61 are so ensured against turning with respect to the car body 11 that they cannot be turned with respect to the car body around a vertical axis.

Figure 5:
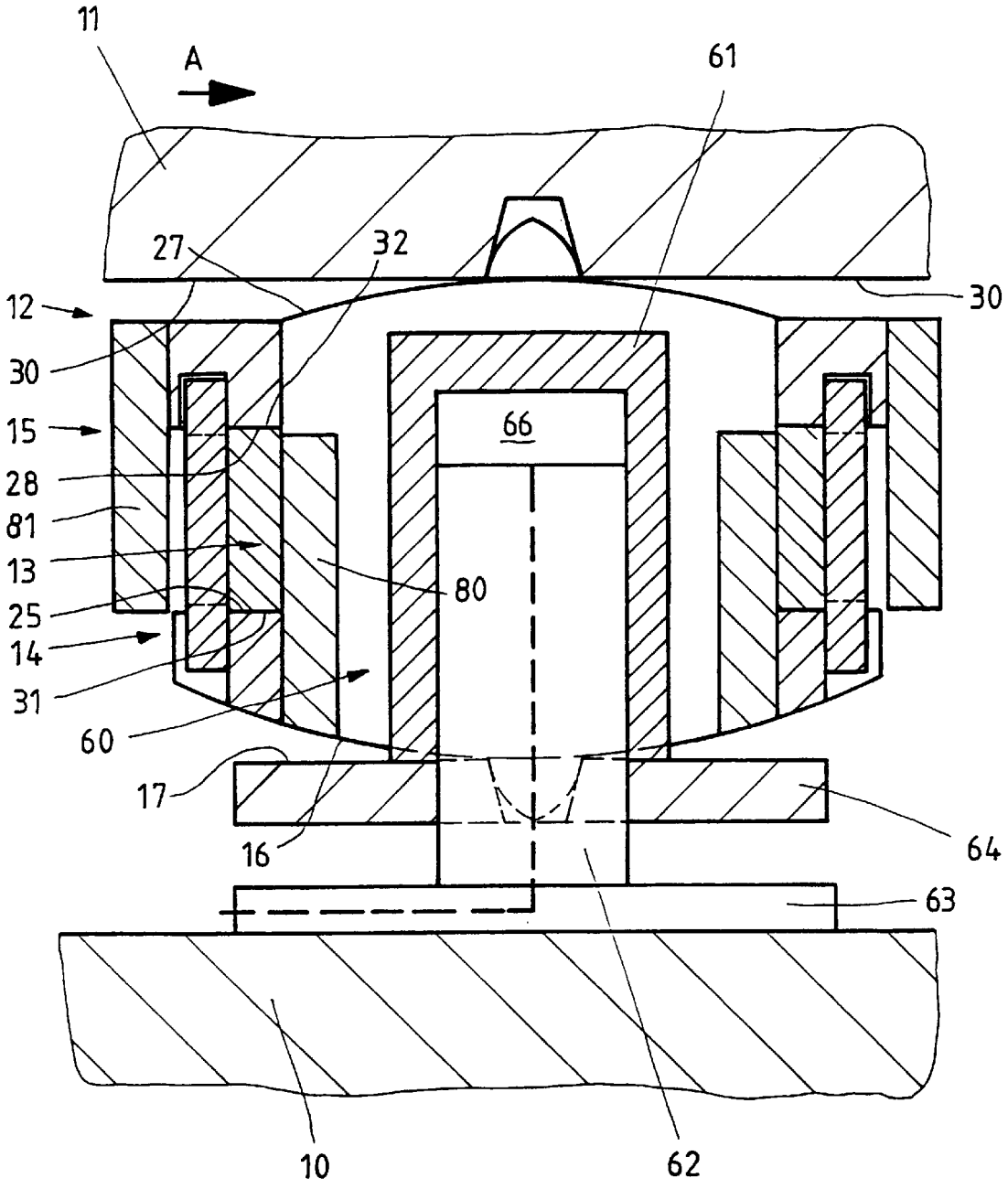
FIG. 5 is a vertical section through the second embodiment the rocker support of which also has a first support part, a second support part and a third support part in which the second support part extends into the first support part and the third support part grips over the first support part on the outside.

The embodiment of FIG. 5 is completely identical, with regard to the piston-cylinder unit 60, with the embodiment of the cylinder 61, the annular flange 64, the plunger piston 62 and the plate 63 5 shown in FIGS. 1 to 4. The central support part 13 may also be identical to the corresponding support part of the embodiments in accordance with FIGS. 1 to 4.

The essential difference between the two embodiments resides in the development of the support parts 14 and 15, of which the support part 14 extends with a hollow cylinder 80 into the support part 13, while the support part 15 extends with a hollow cylinder 81 over the outside of the support part 13. This construction makes it possible to lengthen the hollow cylinders 80 and 81 as compared with the embodiment of FIGS. 1 to 4 beyond a horizontal central plane of the rocker support 12 and thus make the support parts 14 and 15 particularly stable in shape. To be sure, the two support parts 14 and 15 are now different from each other. With regard to the contact between the rolling surfaces 16 and 17, 25 and 31, 28 and 32, as well as 27 and 30, the difference in the development of the support parts 14 and 15 does not lead to differences from the embodiment in accordance with FIGS. 1 to 4.

In the figures, the cylinder 61 and the piston 62 are in a given position with respect to each other which results in a given distance between the truck 10 and the car body 11. Should the distance between the truck 10 and the car body 11 be increased, then pressure fluid is fed to the pressure chamber 66 between the cylinder 61 and the piston 62, as a result of which the cylinder 61 is raised, together with the rocker support 12 and the car body 11. Conversely, upon the letting of pressure out of the pressure chamber 66, the distance between the car body 11 and the truck 10 is reduced.

The different positions of the cylinder 61 and the piston 62 with respect to each other have no effect on the behavior of the rocker support. If a force in the direction of the arrow A acts on the car body 11 for instance, then the car body 11 will be moved in the direction of the arrow A with respect to the truck 10. As a result, the rocker support 12 moves out of the central position shown, the two surfaces 16 and 17 of the support part 14 and the plate 64 as well as the two surfaces 27 and 30 of the support part 15 and of the car body 11 roll on each other. The rocker support 12 moves into an oblique position, in connection with which, due to the size selected for the curvatures of the circular-cylindrical rolling surfaces 16 and 27 and the minimum distance between the car body 11 and the plate 64, the distance between the car body and the plate 64 is increased and the car body therefore raised. As a result, a restoring force acts on the car body 11. Upon a longitudinal displacement of the car body 11 with respect to the truck 10, the rolling surfaces 31 and 25, on the one hand, and the rolling surfaces 32 and 28, on the other hand, roll on each other. In this connection also the car body 11 is raised. Upon a movement of the car body 11 with respect to the truck 10, which has both a component in transverse direction and a component in longitudinal direction, all the rolling surfaces roll on each other.

What is claimed is:

1. A support for a car body (11) on a truck (10) of a rail vehicle, comprising: a fluid-actuated piston-cylinder unit (60) arranged between the car body (11) and the chassis (10), with a rocker support (12) also arranged between the car body (11) and the chassis (10), wherein said rocker support (12) comprises a first support part (13) and a second support part (14) which is arranged between the first support part (13) and a car part, each support part (13, 14) having a rolling surface (31, 25, 16) with which it rests on another rolling surface (25, 31, 17) and at least one rolling surface (31, 16) of the two contacting rolling surfaces (31, 25; 16, 17) is cylindrical and the contact between a pair of the rolling surfaces (31, 25; 16, 17) is linear; at least one support part of the two support parts (13, 14) is of annular development; the piston-cylinder unit (60) is located inside the at least one annular support part; and a cylinder (61) of the piston-cylinder unit (60) is provided with an outer flange (64) against which the annular support part rests via the rolling surface (16) and the piston (62) of the piston-cylinder unit (60) rests against another part.

2. A support according to claim 1, wherein the piston-cylinder unit (60) is arranged between the car part (10) and the second support part (14) which is of annular development, the piston (62) resting on the car part (10) and the cylinder (61) of the piston-cylinder unit (60) resting on the second support part (14).

3. A support according to claim 2, wherein the piston-cylinder unit (60) is arranged between the chassis (10) and the second support part (14).

4. A support according to claim 1, wherein a plurality of support parts (13, 14, 15) are of annular development and the piston-cylinder unit (60) is arranged within the plurality of annular support parts (13, 14, 15).

5. A support according to claim 1, wherein the outer flange (64) extends entirely around the cylinder (61).

6. A support for a car body (11) on a truck (10) of a rail vehicle, comprising: a fluid-actuated piston-cylinder unit (60) arranged between the car body (11) and the chassis (10), with a rocker support (12) also arranged between the car body (11) and the chassis (10), wherein said rocker support (12) comprises a first support part (13) and a second support part (14) which is arranged between the first support part (13) and a car part, each support part (13, 14) having a rolling surface (31, 25, 16) with which it rests on another rolling surface (25, 31, 17) and at least one rolling surface (31, 16) of the two contacting rolling surfaces (31, 25; 16, 17) is cylindrical and the contact between a pair of the rolling surfaces (31, 25; 16, 17) is linear; at least one support part of the two support parts (13, 14) is of annular development; the piston-cylinder unit (60) is located inside the at least one annular support part; and a cylinder (61) of the piston-cylinder unit (60) is provided with an outer flange (64) against which the annular support part rests via the rolling surface (16) and the piston (62) of the piston-cylinder unit (60) rests against another part; and wherein the outer flange (64) is provided with a rolling surface (17).

7. A support for a car body (11) on a truck (10) of a rail vehicle, comprising: a fluid-actuated piston-cylinder unit (60) arranged between the car body (11) and the chassis (10), with a rocker support (12) also arranged between the car body (11) and the chassis (10), wherein said rocker support (12) comprises a first support part (13) and a second support part (14) which is arranged between the first support part (13) and a car part, each support part (13, 14) having a rolling surface (31, 25, 16) with which it rests on another rolling surface (25, 31, 17) and at least one rolling surface (31, 16) of the two contacting rolling surfaces (31, 25; 16, 17) is cylindrical and the contact between a pair of the rolling surfaces (31, 25; 16, 17) is linear; at least one support part of the two support parts (13, 14) is of annular development; the piston-cylinder unit (60) is located inside the at least one annular support part; and a cylinder (61) of the piston-cylinder unit (60) is provided with an outer flange (64) against which the annular support part rests via the rolling surface (16) and the piston (62) of the piston-cylinder unit (60) rests against another part; and wherein: the second support part (14) is of annular development and has a block (72) with rolling surface (25) on a hollow cylinder (70); the first support part (13) is of annular development and rests via rolling surface (31) on the block (72) of the second support part (14); and the hollow cylinder (70) of the second support part (14) extends over the block (72) in a direction towards the first support part (13).

8. A support according to claim 7, wherein the second support part (14) extends into the inside of the first support part (13).

9. A support according to claim 7, wherein the second support part grips on the outside axially over the first support part.

10. A support for a car body (11) on a truck (10) of a rail vehicle, comprising: a fluid-actuated piston-cylinder unit (60) arranged between the car body (11) and the chassis (10), with a rocker support (12) also arranged between the car body (11) and the chassis (10), wherein said rocker support (12) comprises a first support part (13) and a second support part (14) which is arranged between the first support part (13) and a car part, each support part (13, 14) having a rolling surface (31, 25, 16) with which it rests on another rolling surface (25, 31, 17) and at least one rolling surface (31, 16) of the two contacting rolling surfaces (31, 25; 16, 17) is cylindrical and the contact between a pair of the rolling surfaces (31, 25; 16, 17) is linear; at least one support part of the two support parts (13, 14) is of annular development; the piston-cylinder unit (60) is located inside the at least one annular support part; and a cylinder (61) of the piston-cylinder unit (60) is provided with an outer flange (64) against which the annular support part rests via the rolling surface (16) and the piston (62) of the piston-cylinder unit (60) rests against another part;

wherein a plurality of support parts (13, 14, 15) are of annular development and the piston-cylinder unit (60) is arranged within the plurality of annular support parts (13, 14, 15); and wherein: the rocker support (12) has a third support part (15) which is arranged between the first support part (13) and car part (11); and the third support part (15) is of annular development.

11. A support according to claim 10, wherein the third support part (15) extends with a hollow cylinder (70) into the first support part (13).

12. A support according to claim 10, wherein the third support part (15) engages axially on the outside over the first support part (13).

13. A support according to claim 11, wherein the second support part (14) and the third support part (15) both extend on the outside an equal distance axially over the first support part (13).

14. A support according to claim 13, wherein a hollow cylinder (70) of the second support part (14) and the hollow cylinder (70) of the third support part (15) extend close to a central horizontal plane of the rocker support (12).

15. A support according to claim 12, wherein the second support part (14) and the third support part (15) both extend on the inside an equal distance axially over the first support part (13).

16. A support according to claim 15, wherein a hollow cylinder (70) of the second support part (14) and a hollow cylinder (70) of the third support part (15) extend close to a central horizontal plane of the rocker support (12).

* * * * *